US010465668B2

(12) United States Patent
Merz et al.

(10) Patent No.: US 10,465,668 B2
(45) Date of Patent: Nov. 5, 2019

(54) AXIAL PISTON MACHINE

(71) Applicant: Robert Bosch GmbH, Stuttgart (DE)

(72) Inventors: Armin Merz, Weinstadt (DE); Eberhard Maier, Koengen (DE); Dirk Vahle, Eberdingen (DE); Francois Brusset, Paris (FR)

(73) Assignee: Robert Bosch GmbH, Stuttgart (DE)

( * ) Notice: Subject to any disclaimer, the term of this patent is extended or adjusted under 35 U.S.C. 154(b) by 202 days.

(21) Appl. No.: 15/526,972

(22) PCT Filed: Sep. 29, 2015

(86) PCT No.: PCT/EP2015/072414
§ 371 (c)(1),
(2) Date: May 15, 2017

(87) PCT Pub. No.: WO2016/078812
PCT Pub. Date: May 26, 2016

(65) Prior Publication Data

US 2017/0321668 A1 Nov. 9, 2017

(30) Foreign Application Priority Data

Nov. 18, 2014 (DE) ..... 10 2014 223 492

(51) Int. Cl.
*F04B 11/00* (2006.01)
*F04B 1/20* (2006.01)

(52) U.S. Cl.
CPC ..... *F04B 11/0025* (2013.01); *F04B 1/20* (2013.01); *F04B 11/00* (2013.01)

(58) Field of Classification Search
CPC .... F01B 3/0032; F01B 3/0052; F01B 3/0055; F04B 1/20; F04B 1/2021; F04B 11/00;
(Continued)

(56) References Cited

U.S. PATENT DOCUMENTS 5,105,723 A * 4/1992 Kazahaya ..... F04B 1/2021 91/485
5,247,869 A * 9/1993 Palmberg ..... F04B 11/0008 91/487
6,086,336 A * 7/2000 Welschof ..... F04B 1/2042 417/308

FOREIGN PATENT DOCUMENTS

DE 28 50 803 A1 7/1980
DE 197 06 114 A1 8/1998
DE 10 2012 218 879 A1 5/2013

OTHER PUBLICATIONS

International Search Report corresponding to PCT Application No. PCT/EP2015/072414, dated Dec. 7, 2015 (German and English language document) (6 pages).

* cited by examiner

*Primary Examiner* — Philip E Stimpert
(74) *Attorney, Agent, or Firm* — Maginot, Moore & Beck LLP

(57) ABSTRACT

An axial piston machine for at least one of a pump and a motor operation includes a housing, connection plate, piston drum, and working piston. The connection plate is connected to the housing. The piston drum is arranged on a rotatable drive shaft in the housing interior and defines at least one cylinder bore. The working piston is arranged in a longitudinally displaceable manner in the cylinder bore. The cylinder bore delimits a cylinder space having a changeable volume. The cylinder space is configured to connect to at least one pre-compression space via at least one hydraulic connection. The at least one pre-compression space is defined by a cavity within the connection plate. The cavity is defined by the connection plate and a closing element. The closing element is arranged between the connection plate and the housing interior.

9 Claims, 1 Drawing Sheet

(58) Field of Classification Search
CPC ..... F04B 11/0008; F04B 11/0016; F04B 11/0033
See application file for complete search history.

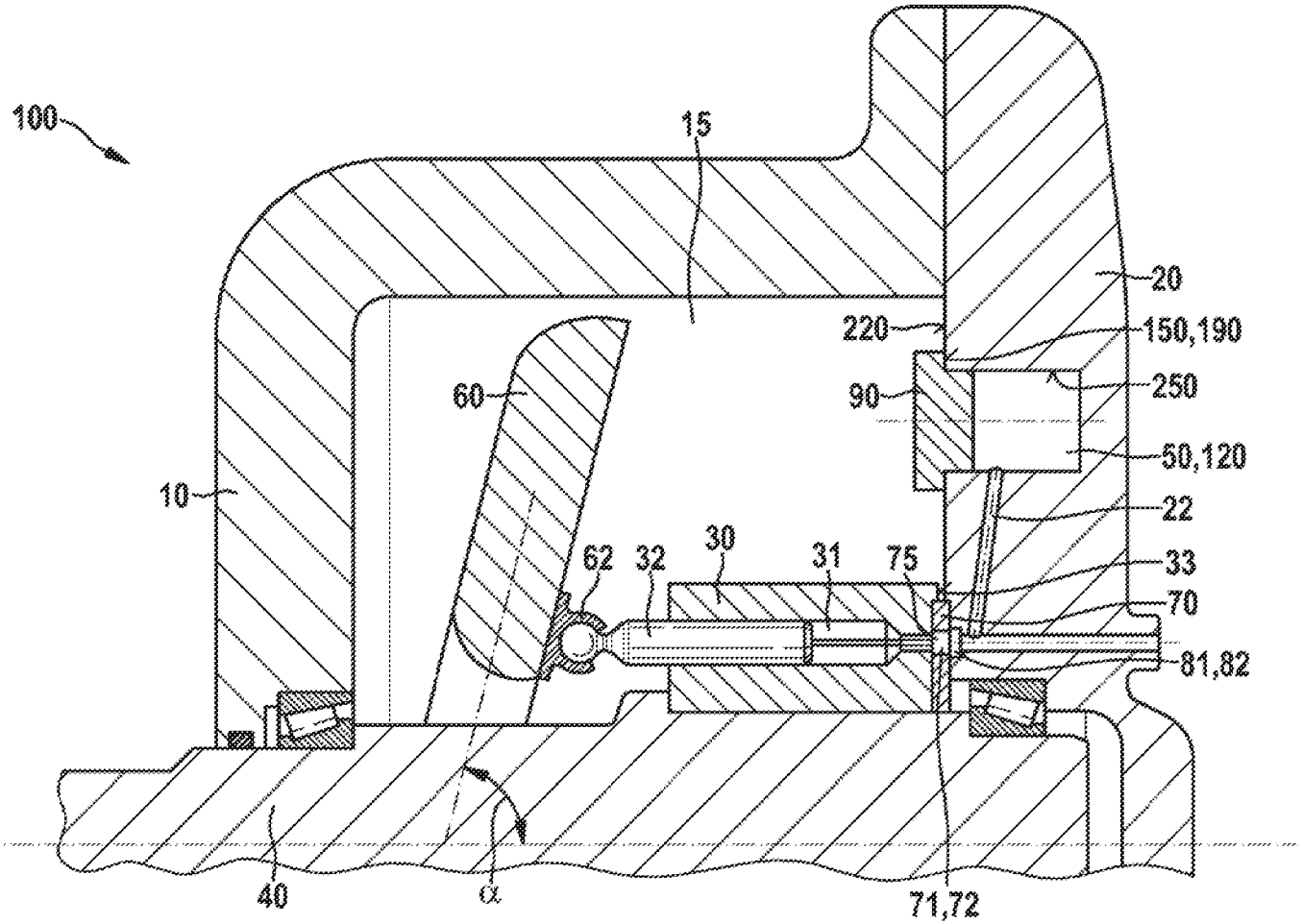
100
10
15
20
150,190
250
50,120
22
33
70
81,82
71,72
220
90
75
31
30
32
62
60
α
40

AXIAL PISTON MACHINE

This application is a 35 U.S.C. § 371 National Stage Application of PCT/EP2015/072414, filed on Sep. 29, 2015, which claims the benefit of priority to Serial No. DE 10 2014 223 492.1, filed on Nov. 18, 2014 in Germany, the disclosures of which are incorporated herein by reference in their entirety.

The disclosure relates to an axial piston machine for pump and/or motor operation.

BACKGROUND

In axial piston machines, at least one working piston is mounted in a longitudinally displaceable manner in a cylinder bore of a piston drum and forms a cylinder space with the cylinder bore. The cylinder space is alternately compressed and decompressed by the longitudinal movement of the working piston and, accordingly, alternately connected to a high-pressure reservoir and a low-pressure reservoir. When changing from the low-pressure reservoir connection to the high-pressure reservoir connection, pulsations occur which can result in substantial noise generation. To counteract this, so-called pre-compression volumes are used, which are formed by pre-compression spaces.

Axial piston machines having pre-compression spaces or zones are known from, the prior art, for example from DE 197 06 114 C5. In this, a pre-compression volume or a reservoir element is integrated in a control plate or in a connection plate of the axial piston machine. The pre-compression volumes known from the prior art can additionally be controlled via valve devices.

The known pre-compression spaces are sealed or closed outside the housing of the axial piston machine, which requires additional installation space. With regard to automobile applications, the installation space is an increasingly important issue for axial piston machines.

The seal of the pre-compression spaces moreover poses a technical challenge owing to the pulsation.

The object of the disclosure is to reduce the installation space for creating pre-compression spaces.

SUMMARY

With regard to the axial piston machine, the object is achieved by the features of disclosed herein.

The axial piston machine according to the disclosure for pump and/or motor operation has a housing, a connection plate connected to the housing and a piston drum arranged on a rotatable drive shaft in the housing interior, wherein at least one cylinder bore is formed in the piston drum, in which cylinder bore a working piston is arranged in a longitudinally displaceable manner and, with the cylinder bore, thus delimits a cylinder space having a changeable volume, wherein the cylinder space may be connected to at least one pre-compression space via at least one hydraulic connection. The at least one pre-compression space is formed by a cavity within the connection plate and the cavity is formed by the connection plate and a closing means, wherein the closing means is arranged between the connection plate and the housing interior.

As a result of arranging the pre-compression space in the connection plate, potential noise sources are shifted into the interior of the axial piston machine and noise emissions to the outside are thereby minimized.

The inventive arrangement of the closing means between the connection plate and the housing interior advantageously ensures a compact design of the axial piston machine. It is moreover possible to dispense with a seal between the closing means and the connection plate since leakage is discharged into the housing interior as a result of the arrangement of the closing means. It is moreover advantageous that only one closing means is required for each pre-compression space.

The attachment to a distributor plate is simplified as a result of the inventive construction of the pre-compression spaces in the connection plate.

The cavity in the connection plate is preferably produced by a milling process. The surfaces produced are thus of higher quality than surfaces produced by a casting process. This ensures an improvement in the pressure resistance of the connection plate which, at the prevailing operating pressures of the axial piston machine, results in a longer service life and less material usage and therefore lower costs.

The cavities can moreover be integrated in the base core during production by a casting process, which simplifies production, facilitates cleaning of the unmachined part and reduces the weight of the finished component. Furthermore, by producing the pre-compression spaces by means of a milling process, it is easier to position the cavities in the connection plate.

In an advantageous embodiment, the closing means and the connection plate have a mutual contact area. As a result of the contact area, the cavity in the pre-compression space is closed with respect to the housing interior of the axial piston machine in such a way that adequate sealing is produced so that the function of the pre-compression space is fulfilled and, if required, a leakage quantity of the working fluid arrives in the housing interior from the pre-compression space.

Furthermore, in one embodiment, the closing means and the connection plate are in direct contact, whereby it is possible to dispense with sealing means between the components. This saves on material and reduces costs.

In a further development of the disclosure, the closing means is a screw. It is thus possible to close the cavity of the pre-compression space in a simple manner. A screw can be incorporated in the connection plate by known assembly processes.

A further development of the disclosure provides for a hydraulic connection to a distributor plate to be formed in the connection plate for each pre-compression space.

A complex alternative hydraulic connection of the pre-compression space to the switchable cylinder space is thus omitted.

By using a connection plate and a distributor plate, the respective materials can furthermore be optimally selected for their functions. The material of the distributor plate here should primarily be selected in consideration of the tribological conditions of the cooperation between the piston drum and the distributor plate. The material of the connection plate should be easily machinable whilst having a high strength in relation to weight.

In a further development of the disclosure, the pre-compression space forms a pre-compression volume for reducing a hydraulic pulsation of the axial piston machine.

The reduction in the hydraulic pulsation of the axial piston machine has a positive effect on the noise properties, which is advantageous for mobile applications, in particular for using axial piston machines in a motor vehicle.

BRIEF DESCRIPTION OF THE DRAWING

The drawing shows:

FIG. 1: an embodiment of the axial piston machine according to the invention disclosure.

DETAILED DESCRIPTION

FIG. 1 shows an axial piston machine 100 for pump and/or motor operation in a longitudinal section wherein only one half is shown, having a housing 10, which is screwed to a connection plate 20. A rotatable drive shaft 10 is mounted in the housing 10 and in the connection plate 20. A substantially cylindrical piston drum 30 is arranged on the drive shaft 40 such that it executes the same rotational movement as the drive shaft 40. The connection of the drive shaft 40 and the piston drum 30 is typically effected via a gearing (not illustrated).

At least one, but preferably seven to eleven, cylinder bores 31 are formed in an axially parallel manner in the piston drum 30. A working piston 32 is arranged in a longitudinally displaceable manner in each cylinder bore 31 and, with the cylinder bore 31, thus delimits a cylinder space 31 having a changeable volume. Accordingly, there are as many working pistons 32 and cylinder spaces 31 as there are cylinder bores 31.

A pivot cradle 60 is arranged in a non-rotatable manner in the housing 10. The pivot cradle 60 is mounted in a pivotal manner by means of a bearing (not illustrated) so that it can be brought to an adjustment angle $\alpha$ of greater or less than 90° with respect to the drive shaft 40 with the aid of at least one, but preferably two adjusting units (not illustrated). If the adjustment angle $\alpha$ is precisely 90°, then the axial piston machine 100 is in idle mode.

Sliding blocks 62 can slide along the pivot cradle 60, in which sliding blocks the working pistons 32 are mounted by means of a ball bearing; i.e. the number of sliding blocks 62 is equal to the number of working pistons 32. The sliding blocks 62 are held down on the pivot cradle 60 via a device (not illustrated), so that pressure forces are constantly transmitted between the pivot cradle 60 and the working pistons 32.

A distributor plate 70 is arranged between the rotatable piston drum 30 and the connection plate 20 and fixedly connected to the connection plate 20 so that the piston drum rotates with an end face on the distributor plate 70 or on a dynamic lubricating film which is formed between the two components during operation. A filling bore 75 is formed in the distributor plate 70, which filling bore is hydraulically connected to a hydraulic connection 22 formed in the connection plate 20, wherein the hydraulic connection 22 leads into a pre-compression space 50. The hydraulic connection 22 is designed as a connecting bore or through bore in the embodiment outlined. Alternatively, and depending on the geometric design of the pre-compression space 50, the hydraulic connection 22 can also be produced by other manufacturing methods, for example casting.

The pre-compression space 50 is formed by a cavity 120 within the connection plate 20 and the cavity 120 is formed by the connection plate 20 and a closing means 90, wherein the closing means 90 is arranged between the connection plate 20 and the housing interior 15.

The closing means 90 is realized by a screw and this has a contact area 150 with the connection plate 20. The contact area 150 is formed by a surface 220 of the connection plate 20 which faces the housing interior 15 and a bearing area 190 of the screw head on the surface 220 of the connection plate 20. The contact is produced in the screwed-in state.

A surface 250 formed in the pre-compression space 50 is machined using a milling process and has an internal thread for receiving the screw.

The number and size of the pre-compression spaces 50 are dependent on the particular application and on the installation space available in the housing 10 and in the connection plate 20.

At least one low-pressure kidney 71 and at least one high-pressure kidney 72 are furthermore formed in the distributor plate 70. These are connected to a suction kidney 81 and a pressure kidney 82 respectively, which are both formed in the connection plate 20. The suction kidney 81 leads into a low-pressure bore (not illustrated) and the pressure kidney 82 leads into a high-pressure bore (not illustrated) which are likewise both formed in the connection plate 20. At the end opposite the distributor plate 70, the connection plate 20 has a low-pressure connection (not illustrated) and a high-pressure connection (not illustrated). The low-pressure connection connects the low-pressure bore to a low-pressure reservoir (not illustrated) and the high-pressure connection connects the high-pressure bore to a high-pressure reservoir (not illustrated).

Therefore, different hydraulic connections of a cylinder space 31 are controlled depending on the rotational angle position of the drive shaft 40:

- In a first rotational angle position of the drive shaft 40, a first hydraulic connection from the cylinder space 31 via the filling bore 75 and the connection bore 22 into the pre-compression space 50, in particular the low-pressure pre-compression space, is opened.
- Then, in a second rotational angle position of the drive shaft 40, a second hydraulic connection from the cylinder space 31 via the at least one low-pressure kidney 71 to the low-pressure bore and therefore to the low-pressure reservoir is opened, whilst the first hydraulic connection to the low-pressure pre-compression space is simultaneously present.
- Then, in a third rotational angle position of the drive shaft 40, the second hydraulic connection alone is opened.
- In a fourth rotational angle position of the drive shaft 40, before the cylinder space 31 produces a hydraulic connection to the high-pressure kidney 72, a third hydraulic connection from the cylinder space 31 via the filling bore 75 and the connecting bore 22 into the pre-compression space 50, in particular the high-pressure pre-compression space, is opened.
- Then, in a fifth rotational angle position of the drive shaft 40, a fourth hydraulic connection from the cylinder space 31 via the at least one high-pressure kidney 72 to the high-pressure bore, and therefore to the high-pressure reservoir, is opened, whilst the third hydraulic connection to the high-pressure pre-compression space is simultaneously present.
- Then, in a sixth rotational angle position of the drive shaft 40, the fourth hydraulic connection from the cylinder space 31 via the at least one high-pressure kidney 72 to the high-pressure bore, and therefore to the high-pressure reservoir, alone is opened.

During operation, working fluid from the working pistons 32, which are connected on the path from an upper to a lower dead center position and to the low-pressure reservoir, is extracted via the second hydraulic connection and then moved from the lower into the upper dead center position by means of the rotation piston drum 40 and thereby compressed in the decreasing cylinder space 31 in that the sliding blocks 62 slide along a circular path of the pivot cradle 60 and thereby press the working pistons 32 into the cylinder bores 31 on their path from the lower to the upper dead center and thus decrease the cylinder spaces 31. In this region, the cylinder spaces 31 are connected to the high-pressure reservoir via the third hydraulic connection and the working fluid is therefore supplied to the high-pressure reservoir.

The critical rotational angle position is as follows:

If a cylinder space 31 which is under low pressure starts to move via the high-pressure kidney 72 owing to the rotation of the piston drum 30 and is therefore connected to the high-pressure reservoir, this results in a "sudden" virtually unthrottled filling of the cylinder space 31 with fluid under high pressure. This transmission is critical in terms of both strength and noise.

This critical rotational angle position is eased by the use of a pre-compression volume in the pre-compression space 50:

During the transition from the low-pressure region to the high-pressure region, a pre-compression space 50 is hydraulically connected such that it is connected to the cylinder space 31 via the first hydraulic connection as soon as the cylinder space 31 is no longer connected to the low-pressure reservoir via the second hydraulic connection; otherwise, there would be a "short circuit" between the low-pressure reservoir and the pre-compression space 50. In this position, the third hydraulic connection is still closed. As a result of the throttling function within the first hydraulic connection, the cylinder space 31 is placed under high pressure relatively slowly. Upon a further rotational movement of the piston drum 30, the third hydraulic connection between the cylinder space 31 and the high-pressure reservoir is opened; working fluid is pressed into the high-pressure reservoir owing to the decreasing cylinder space 31. At the same time, the first hydraulic connection is still open so that the pre-compression space 50, which is decompressed with respect to the high-pressure reservoir, is refilled.

By comparison with an arrangement outside the housing 10, the arrangement of the at least one pre-compression space 50 in the connection plate 20 presents an arrangement which saves on installation space, for example, and the NVH (Noise Vibration Harshness) behavior and the sound radiation are improved.

The invention claimed is:

1. An axial piston machine for at least one of a pump and a motor operation, comprising:

a housing defining a housing interior;

a connection plate connected to the housing;

a piston drum arranged on a rotatable drive shaft in the housing interior and defining at least one cylinder bore; and a working piston arranged in a longitudinally displaceable manner in the cylinder bore, wherein the cylinder bore delimits a cylinder space having a changeable volume, wherein the cylinder space is configured to be connected to at least one pre-compression space via at least one hydraulic connection, wherein the at least one pre-compression space is defined by a cavity within the connection plate and the cavity is defined by the connection plate and a closing structure, and wherein the closing structure is arranged between the connection plate and the housing interior, and wherein, during rotation of the piston drum, the cylinder space is hydraulically connected to the pre-compression space prior to being hydraulically connected to a high-pressure connection.

2. The axial piston machine as claimed in claim 1, wherein the closing structure and the connection plate have a mutual contact area.

3. The axial piston machine as claimed in claim 2, wherein the closing structure and the connection plate are in direct contact.

4. The axial piston machine as claimed in claim 1, wherein the closing structure is a screw.

5. The axial piston machine as claimed in claim 1, wherein a hydraulic attachment to a distributor plate is formed in the connection plate for each pre-compression space.

6. The axial piston machine as claimed in claim 1, wherein the at least one pre-compression space defines a pre-compression volume configured to reduce a hydraulic pulsation of the axial piston machine.

7. The axial piston machine as claimed in claim 1, wherein, during the rotation of the piston drum, the cylinder space is hydraulically connected to the pre-compression space between being hydraulically connected to a low-pressure connection and the high-pressure connection.

8. The axial piston machine as claimed in claim 7, wherein, during rotation of the piston drum, the cylinder space remains hydraulically connected to the pre-compression space after being hydraulically connected to the high-pressure connection.

9. An axial piston machine as for at least one of a pump and a motor operation, comprising:

a housing defining a housing interior;

a connection plate connected to the housing;

a piston drum arranged on a rotatable drive shaft in the housing interior and defining at least one cylinder bore; and a working piston arranged in a longitudinally displaceable manner in the cylinder bore, wherein the cylinder bore delimits a cylinder space having a changeable volume, wherein the cylinder space is configured to be connected to at least one pre-compression space via at least one hydraulic connection, wherein the at least one pre-compression space is defined by a cavity within the connection plate and the cavity is defined by the connection plate and a closing structure, and wherein the closing structure is arranged between the connection plate and the housing interior, and wherein the closing structure hydraulically separates the pre-compression space from the housing interior.

* * * * *